US009267505B2

(12) United States Patent
Yanagisawa et al.

(10) Patent No.: US 9,267,505 B2
(45) Date of Patent: Feb. 23, 2016

(54) COUNTER-ROTATING AXIAL FLOW FAN

(75) Inventors: Atsushi Yanagisawa, Nagano (JP); Honami Oosawa, Nagano (JP)

(73) Assignee: SANYO DENKI CO., LTD., Tokyo (JP)

( * ) Notice: Subject to any disclaimer, the term of this patent is extended or adjusted under 35 U.S.C. 154(b) by 925 days.

(21) Appl. No.: 13/440,213

(22) Filed: Apr. 5, 2012

(65) Prior Publication Data

US 2012/0257957 A1 Oct. 11, 2012

(30) Foreign Application Priority Data

Apr. 8, 2011 (JP) ..... 2011-086080

(51) Int. Cl.
*F04D 19/00* (2006.01)
*F04D 19/02* (2006.01)
*F04D 29/38* (2006.01)

(52) U.S. Cl.
CPC ..... *F04D 19/007* (2013.01); *F04D 19/024* (2013.01); *F04D 29/386* (2013.01)

(58) Field of Classification Search
CPC ... F04D 19/024; F04D 19/026; F04D 29/522; F04D 25/08; F04D 19/007
See application file for complete search history.

(56) References Cited

U.S. PATENT DOCUMENTS 5,931,640 A * 8/1999 Van Houten et al. ..... 416/128
2003/0133791 A1 7/2003 Huang et al.
2005/0271521 A1 12/2005 Kim et al.
2006/0045736 A1 3/2006 Lee et al.
2007/0059155 A1* 3/2007 Ishihara et al. ..... 415/60
2008/0031723 A1 2/2008 Yoshida
2009/0047118 A1 2/2009 Ishihara et al.

FOREIGN PATENT DOCUMENTS

JP 2001-295793 10/2001
JP 4128194 7/2008

OTHER PUBLICATIONS

European Search Report dated Nov. 4, 2014, 9 pages.
Maliczak, Christophe, "Development of an Analytical Tool to Predict the Noise Emitted by a Diesel Cooling Fan Unit", European Commission DG Research, Jan. 1, 2007, 42 pages.
Taiwanese Office Action dated Oct. 8, 2015, with English Summary and Applicant's Comments, 5 pages.
Chinese Office Action dated Jun. 30, 2015, with excerpts of English Translation, 4 pages.

* cited by examiner

*Primary Examiner* — Craig Kim
*Assistant Examiner* — Adam W Brown
(74) *Attorney, Agent, or Firm* — Rankin, Hill & Clark LLP

(57) ABSTRACT

Provided here is a counter-rotating axial flow fan with improved air flow-static pressure characteristics and reduced power consumption and noise compared to the related art. A plurality of struts are disposed to be stationary between a front impeller and a rear impeller in an air channel. A plurality of front blades are each formed of a swept-back blade, and a plurality of rear blades are each formed of a forward-swept blade.

5 Claims, 14 Drawing Sheets

COUNTER-ROTATING AXIAL FLOW FAN

TECHNICAL FIELD

The present invention relates to a counter-rotating axial flow fan including a front impeller and a rear impeller which are configured to rotate in opposite directions to each other.

BACKGROUND ART

FIGS. 1 and 2 show the structure of a counter-rotating axial flow fan according to the related art disclosed in Japanese Patent No. 4128194 (FIGS. 1 and 2). FIGS. 1A, 1B, 1C, and 1D are a perspective view as viewed from a suction side, a perspective view as viewed from a discharge side, a front view as viewed from the suction side, and a rear view as viewed from the discharge side, respectively, of the counter-rotating axial flow fan according to the related art disclosed in Japanese Patent No. 4128194. FIG. 2A is a vertical cross-sectional view of the counter-rotating axial flow fan of FIG. 1. FIG. 2B shows front blades of the counter-rotating axial flow fan of FIG. 1. FIG. 2C shows rear blades of the counter-rotating axial flow fan of FIG. 1. In FIG. 2, some reference numerals and dimensions are changed from those of Japanese Patent No. 4128194 for illustration. The counter-rotating axial flow fan according to the related art is formed by assembling a first axial flow fan unit 1 and a second axial flow fan unit 3 via a coupling structure. The first axial flow fan unit 1 includes a first case 5, and a first impeller (front impeller) 7, a first motor 25, and three webs 21 disposed in the first case 5. The webs 21 are arranged at intervals of 120° in the circumferential direction. The first case 5 has an annular flange 9 on the suction side at one axial end of the first case 5 in a direction in which axis A extends (in the axial direction), and an annular flange 11 on the discharge side at the other axial end of the first case 5. The first case 5 also has a cylindrical portion 13 between the flanges 9 and 11. The internal spaces of the flange 9, the flange 11, and the cylindrical portion 13 form an air channel. The flange 11 on the discharge side has a circular discharge port 17 formed therein. The three webs 21 are combined with three webs 45 of the second axial flow fan unit 3 to form three stationary blades 61. The first motor 25 rotates the first impeller 7 in the first case 5 in the counterclockwise direction as shown in FIGS. 1A and 1C (in the direction of the arrow R1 in the drawings, which will be referred to as "one direction R1"). The first motor 25 rotates the first impeller 7 at a rotational speed higher than the rotational speed of a second impeller (rear impeller) 35. The first impeller 7 has an annular member (hub) 27 fitted with a cup-shaped member of a rotor (not shown) fixed to a rotary shaft (not shown) of the first motor 25, and N (five) front blades 28 integrally provided on an outer peripheral surface of an annular peripheral wall 27*a* of the annular member 27.

The second axial flow fan unit 3 includes a second case 33, and a second impeller (rear impeller) 35, a second motor 49, and three webs 45 disposed in the second case 33 and shown in FIG. 2. As shown in FIG. 1, the second case 33 has a flange 37 on the suction side at one axial end of the second case 33 in a direction in which axis A extends (in the axial direction), and a flange 39 on the discharge side at the other axial end of the second case 33. The second case 33 also has a cylindrical portion 41 between the flanges 37 and 39. The internal spaces of the flange 37, the flange 39, and the cylindrical portion 41 form an air channel. The first case 5 and the second case 33 form a casing. The flange 37 on the suction side has a circular suction port 42 formed therein. The second motor 49 rotates the second impeller 35 in the second case 33 in the counterclockwise direction as shown in FIGS. 1B and 1D [in the direction of the arrow R2 in the drawings, which will be referred to as "the other direction R2", that is, in the direction opposite to the rotational direction of the first impeller 7 (the direction of the arrow R1)]. As discussed earlier, the second impeller 35 is rotated at a rotational speed lower than the rotational speed of the first impeller 7. The second impeller 35 has an annular member (hub) 50 fitted with a cup-shaped member of a rotor (not shown) fixed to a rotary shaft (not shown) of the second motor 49, and P (four) rear blades 51 integrally provided on an outer peripheral surface of an annular peripheral wall 50*a* of the annular member 50.

As shown in FIG. 25, the front blades 28 are each formed of a swept-back blade. The front blades 28 each have a curved shape in which a recessed portion opens in the one direction R1 (the rotational direction of the impeller 7) discussed above as viewed in lateral cross section. As shown in FIG. 2C, the rear blades 51 are also each formed of a swept-back blade. The rear blades 51 each have a curved shape in which a recessed portion opens in the other direction R2 (the rotational direction of the impeller 35) as viewed in lateral cross section. The stationary blades, or struts, 61 each have a curved shape in which a recessed portion opens in the other direction R2 and in the direction in which the rear blades 51 are located as viewed in lateral cross section.

In the counter-rotating axial flow fan according to the related art, the number N of the front blades 28, the number M of the struts 61, and the number P of the rear blades 51 are each a positive integer, and satisfy a relationship of N>P>M.

Four curved portions 18 and 58 are formed at four corners of both end portions, in the axial direction, of an inner wall portion of the air channel formed by the cylindrical portions 13 and 33. The curved portions 18 and 58 become larger in diameter toward the suction port 15 and the discharge port 57, respectively. The four curved portions 18 and 58 are shaped such that defining the diameter of the inner wall portion of the air channel as $R_o$, the maximum diameter $R_m$ of the curved portions 18 and 58 is approximately $1.06R_o$ at ends of the cylindrical portions 13 and 33 where the diameters of the curved portions 18 and 58 are the largest. In addition, defining the outside diameter of the front blades 28 as $R_f$, the minimum clearance $C_f$ between the front blades 28 and the struts 61 is less than $R_f/6$. Moreover, defining the outside diameter of the rear blades 51 as $R_r$, the minimum clearance $C_r$ between the rear blades 51 and the struts 61 is less than $R_r/8$.

While the counter-rotating axial flow fan according to the related art can improve the air flow-static pressure characteristics, it is further desired to reduce power consumption and noise.

SUMMARY OF THE INVENTION

An object of the present invention is to provide a counter-rotating axial flow fan with improved air flow-static pressure characteristics and reduced power consumption and noise compared to the related art.

A counter-rotating axial flow fan of the present invention includes a casing including an air channel having a suction port at one axial end of the air channel and a discharge port at the other axial end of the air channel; a front impeller including a plurality of front blades and configured to rotate in the air channel; a rear impeller including a plurality of rear blades and configured to rotate in the air channel in a direction opposite to a direction of rotation of the front impeller; and a plurality of struts (or webs) disposed to be stationary between the front impeller and the rear impeller in the air channel.

In the present invention, the plurality of front blades are each formed of a swept-back blade, and the plurality of rear blades are each formed of a forward-swept blade.

It is possible to improve the air flow-static pressure characteristics and to reduce power consumption and noise by using swept-back blades as the front blades and forward-swept blades as the rear blades although the reasons are not known. Herein, the term "swept-back blade" refers to a blade having a curved shape in which an end edge of the blade on the discharge side is located behind an end edge of the blade on the suction side in the rotational direction of the impeller, in which the end edge of the blade on the suction side and the end edge of the blade on the discharge side are inclined in the direction opposite to the rotational direction of the impeller, and in which a recessed portion of the blade opens in the rotational direction of the impeller as viewed in lateral cross section. Meanwhile, the term "forward-swept blade" refers to a blade having a curved shape in which an end edge of the blade on the discharge side is located behind an end edge of the blade on the suction side in the rotational direction of the impeller, in which the end edge of the blade on the suction side and the end edge of the blade on the discharge side are inclined in the rotational direction of the impeller, and in which a recessed portion of the blade opens in the rotational direction of the impeller as viewed in lateral cross section.

Defining the number of the front blades as N, the number of the struts as M, and the number of the rear blades as P, N, M, and P each being a positive integer, a relationship $N \geq P > M$ is preferably satisfied. The rotational speed of the front blades is preferably higher than the rotational speed of the rear blades. The applicant had found in the past that the relationship was preferable for counter-rotating axial flow fans, and verified this time that the relationship was also effective in the present invention.

In addition to the above relationship, a plurality of curved portions are preferably formed at both end portions of an inner wall portion of the air channel in the axial direction. The curved portions become larger in diameter toward the suction port or the discharge port, which improves the air flow-static pressure characteristics and reduces noise. Defining the diameter of the inner wall portion of the air channel as $R_o$, the maximum diameter $R_m$ of the curved portions may be determined as $(1.02 \pm 0.01)R_o$ at an end of the cylindrical portion where the diameter for the curved portions is the largest, which ensures the effect of the present invention.

In addition, defining the outside diameter of the front blades as $R_f$, the minimum clearance $C_f$ between the front blades and the struts may be determined as a value in the range of $R_f/4 > C_f > R_f/6$, which reduces power consumption and noise.

Further, defining the outside diameter of the rear blades as $R_r$, the minimum clearance $C_r$ between the rear blades and the struts may be determined as a value in the range of $R_r/6 > C_r > R_r/8$, which further reduces power consumption and noise.

DESCRIPTION OF THE PREFERRED EMBODIMENTS

Figure 1A:
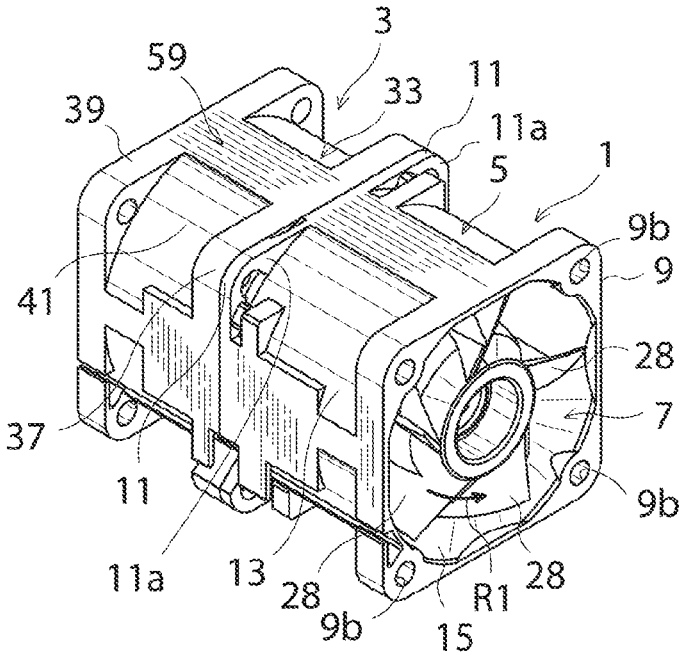
Fig. 1A Prior Art
FIGS. 1A, 1B, 1C, and 1D are a perspective view as viewed from a suction side, a perspective view as viewed from a discharge side, a front view as viewed from the suction side, and a rear view as viewed from the discharge side, respectively, of a counter-rotating axial flow fan according to the related art disclosed in Japanese Patent No. 4128194.
Figure 1B:
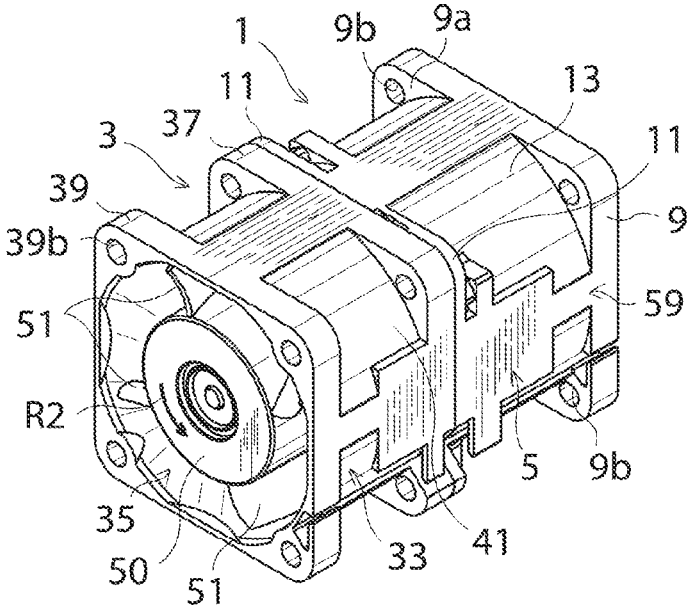
Fig. 1B Prior Art
Figure 1C:
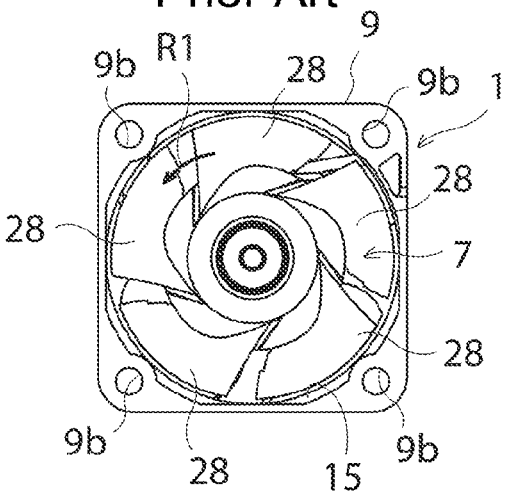
Fig. 1C Prior Art
Figure 1D:
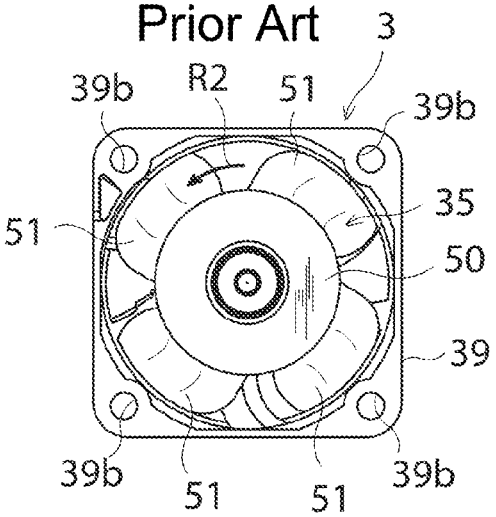
Fig. 1D Prior Art
Figure 2A:
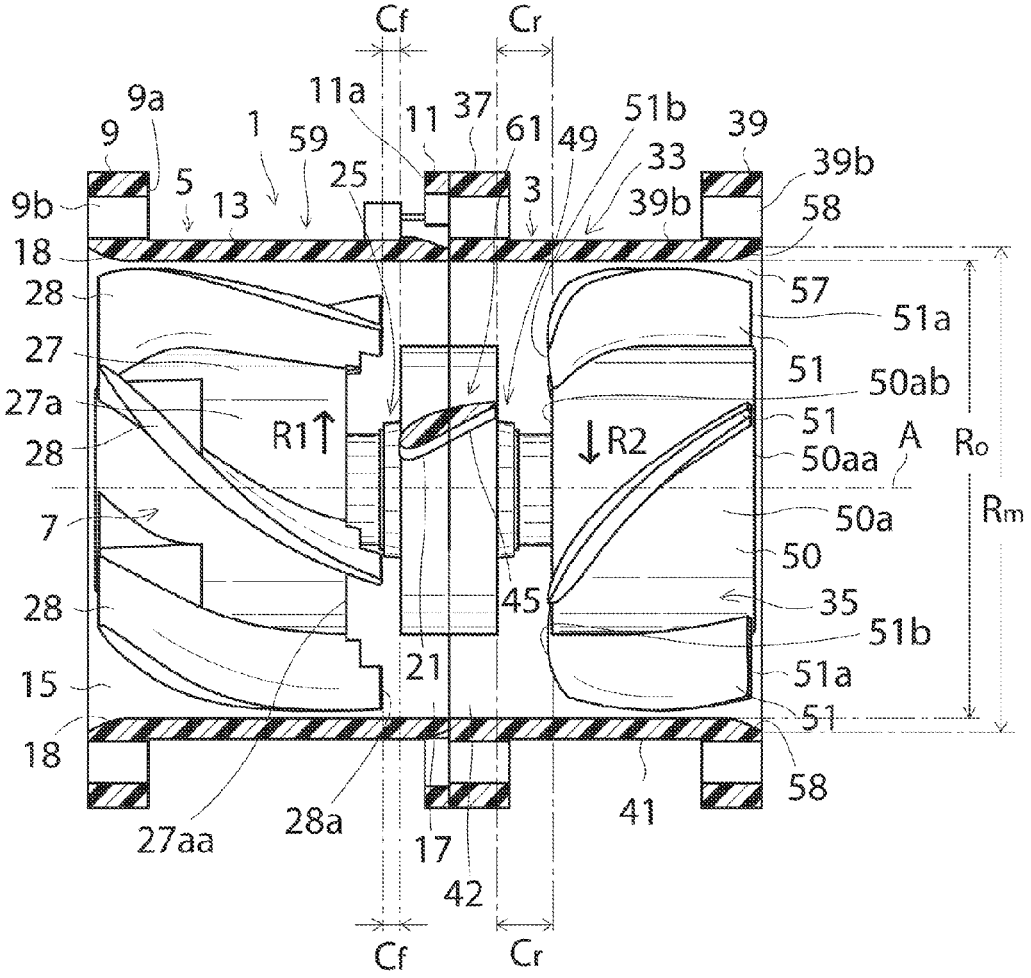
Fig. 2A Prior Art
FIG. 2A is a vertical cross-sectional view of the counter-rotating axial flow fan of FIG. 1.
Figure 2B:
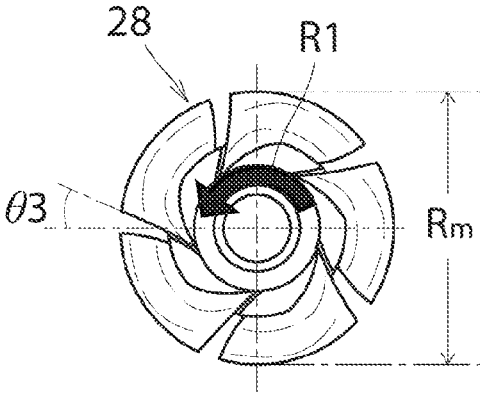
Fig. 2B Prior Art
FIG. 2B shows front blades of the counter-rotating axial flow fan of FIG. 1.
Figure 2C:
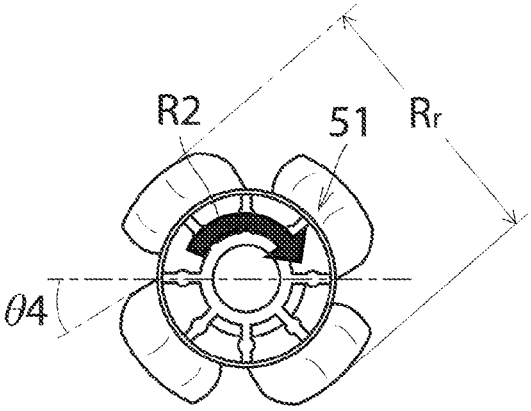
Fig. 2C Prior Art
FIG. 2C shows rear blades of the counter-rotating axial flow fan of FIG. 1.
Figure 3:
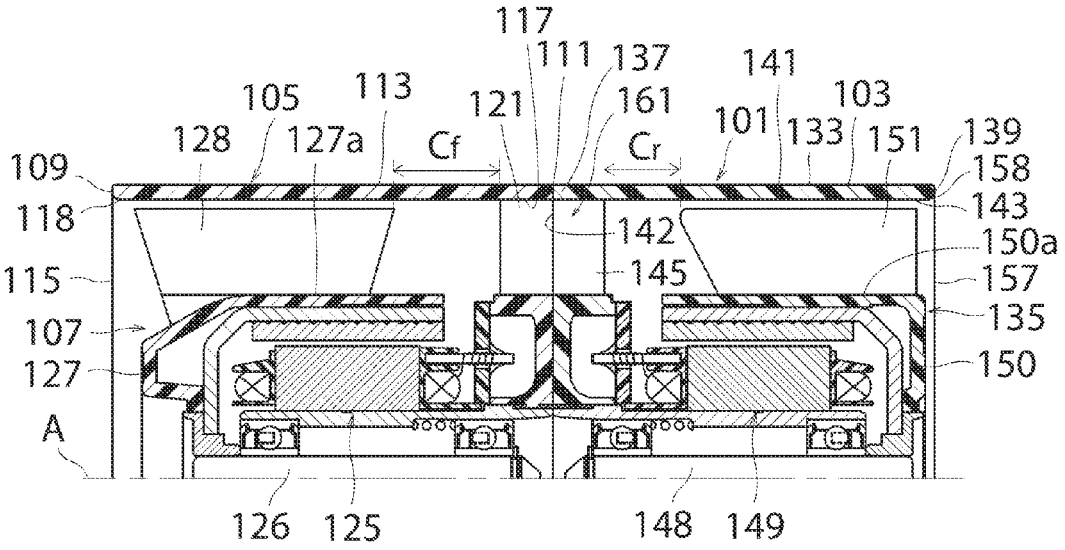
FIG. 3 is a cross-sectional view illustrating the schematic configuration of a halved counter-rotating axial flow fan according to an embodiment of the present invention.

A counter-rotating axial flow fan according to ah embodiment of the present invention will be described below with reference to the drawings. FIG. 3 is a cross-sectional view illustrating the schematic configuration of a halved counter-rotating axial flow fan according to an embodiment of the present invention. The counter-rotating axial flow fan of FIG. 3 is basically the same as the counter-rotating axial flow fan according to the related art shown in FIGS. 1 and 2 except for the shape of a front impeller 107, the shape of a rear impeller 135, and the shape of struts 161. Thus, in the embodiment, parts similar to those of the counter-rotating axial flow fan according to the related art of FIGS. 1 and 2 are denoted by reference numerals obtained by adding 100 to the reference numerals affixed to their counterparts in FIGS. 1 and 2. A first axial flow fan unit 101 and a second axial flow fan unit 103 are assembled with each other via a coupling structure. The first axial flow fan unit 1 includes a first case 105, and a first impeller (front impeller) 107, a first motor 125, and three webs 121 disposed in the first case 105. The webs 121 are arranged at intervals of 120° in a circumferential direction of the first case 105. The first case 105 has an annular flange 109 on the suction side at one axial end of the first case 105 in a direction in which axis A extends (in the axial direction), and an annular flange 111 on the discharge side at the other axial end of the first case 105. The first case 105 also has a cylindrical portion 113 between the flanges 109 and 111. The internal spaces of the flange 109, the flange 111, and the cylindrical portion 113 form an air channel. The flange 111 on the discharge side has a circular discharge port 117 formed therein. The three webs 121 are combined with three webs 145 of the second axial flow fan unit 103 to form three struts 161. The first motor 125 rotates the first impeller 107 in the first case 105 in the counterclockwise direction. The first motor 125 rotates the first impeller 107 at a rotational speed higher than the rotational speed of a second impeller (rear impeller) 135.

Figure 4:
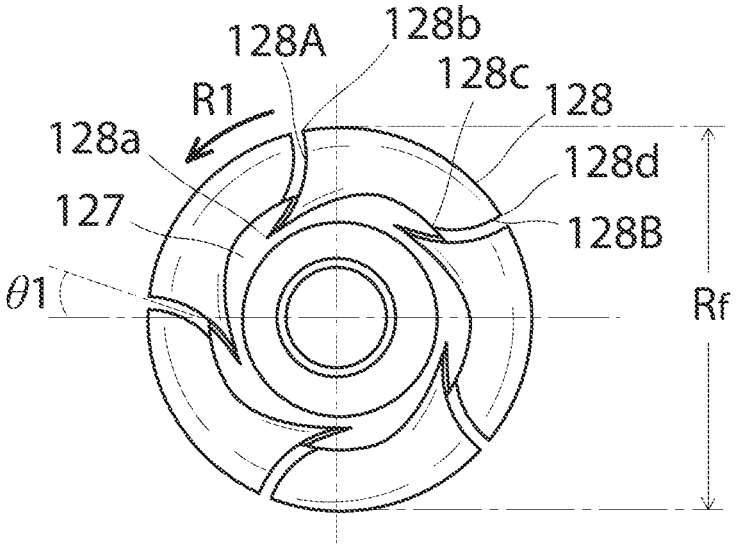
FIG. 4 shows the shape of front blades.
Figure 6:
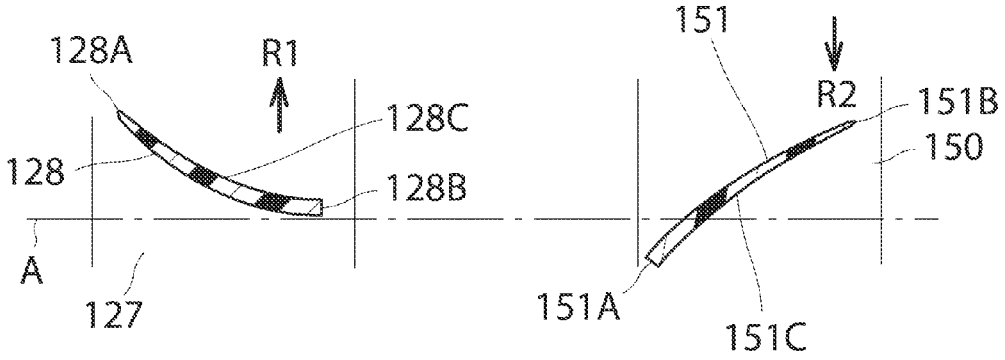
FIG. 6 illustrates lateral cross-sectional shapes of the front blades and the rear blades.

The first impeller 107 has a hub 127 which is an annular member fitted with a cup-shaped member of a rotor (not shown) fixed to a rotary shaft 126 of the first motor 125, and N (five) front blades 128 integrally provided on an outer peripheral surface of an annular peripheral wall 127*a* of the hub 127. In the embodiment, the front blades 128 are each formed of a swept-back blade. As shown in FIGS. 4 and 6, the front blades 128 are each formed of a swept-back blade. The front blades 128 each have a curved shape in which an end edge 128B of the blade on the discharge side is located behind an end edge 128A of the blade on the suction side in the rotational direction R1 of the impeller 107, in which the end edge 128A and the end edge 128B are inclined in the direction opposite to the rotational direction R1, and in which a recessed portion 128C (FIG. 6) opens in the rotational direction R1 as viewed in lateral cross section. In the embodiment, the inclination angle θ1 of the swept-back blades is 25°±3°. The inclination of the end edge 128A and the end edge 128B in the direction opposite to the rotational direction R1 means that end portions 128*b* and 128*d* of the end edge 128A and the end edge 128B on the radially outer side are located behind end portions 128*a* and 128*c* of the end edge 128A and the end edge 128B on the hub 127 side in the rotational direction R1. In the embodiment, defining the outside diameter of the front blades 128 as $R_f$, the minimum clearance $C_f$ between the front blades 128 and the struts 161 is determined to fall within the range of $R_f/4>C_f>R_f/6$. Specifically, in the embodiment, the minimum clearance $C_f$ is $R_f/5.1$. This improves the air flow-static pressure characteristics, and reduces power consumption and noise.

The second axial flow fan unit 103 includes a second case 133, and a second impeller (rear impeller) 135, a second motor 149, and three webs 145 disposed in the second case 133 as shown in FIG. 3. As shown in FIG. 3, the second case 133 has a flange 137 on the suction side at one axial end of the second case 133 in the direction in which the axis A extends (in the axial direction), and a flange 139 on the discharge side at the other axial end of the second case 133. The second case 133 also has a cylindrical portion 141 between the flanges 137 and 139. The internal spaces of the flange 137, the flange 139, and the cylindrical portion 141 form an air channel. The first case 105 and the second case 133 form a casing. The flange 137 on the suction side has a circular suction port 142 formed therein. The flange 139 on the discharge side has a circular discharge port 143 formed therein. The second motor 149 rotates the second impeller 135 in the second case 133 in the clockwise direction in the state shown in FIG. 5 [in the direction of the arrow R2 in the drawing, which will be referred to as "other direction R2", that is, in the direction opposite to the rotational direction of the first impeller 107 (the direction of the arrow R1)]. As discussed earlier, the second impeller 135 is rotated at a rotational speed lower than the rotational speed of the first impeller 107.

Figure 5:
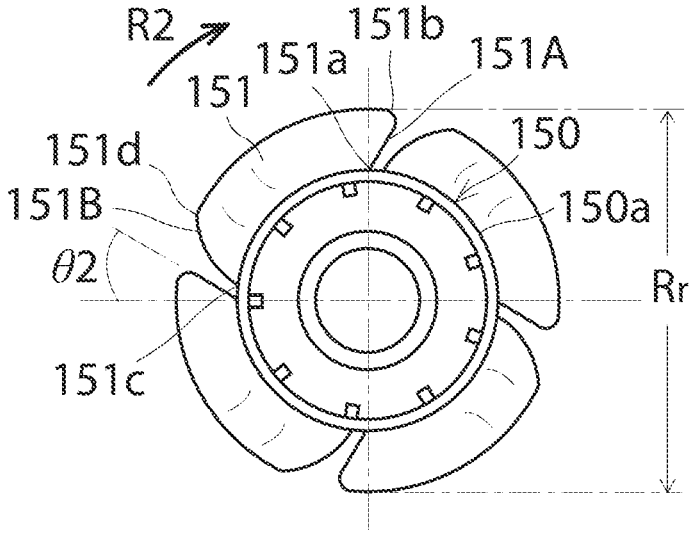
FIG. 5 shows the shape of rear blades.

As shown in FIG. 5, the second impeller 135 has a hub 150 which is an annular member fitted with a cup-shaped member of a rotor (not shown) fixed to a rotary shaft 148 of the second motor 149, and P (four) rear blades 151 integrally provided on an outer peripheral surface of an annular peripheral wall 150*a* of the hub 150. The rear blades 151 are each formed of a forward-swept blade. The rear blades 151 formed of forward-swept blades each have a curved shape in which an end edge 151B of the blade on the discharge side is located behind an end edge 151A of the blade on the suction side in the rotational direction R2 of the impeller 135, in which the end edge 151A and the end edge 151B are inclined in the rotational direction R2, and in which a recessed portion 151C (FIG. 6) opens in the rotational direction R2 as viewed in lateral cross section. In the embodiment, the inclination angle θ2 of the forward-swept blades is 30°±3°. The inclination of the end edge 151A and the end edge 151B in the rotational direction R2 means that end portions 151*b* and 151*d* of the end edge 151A and the end edge 151B on the radially outer side are located ahead of end portions 151*a* and 151*c* of the end edge 151A and the end edge 151B on the hub 150 side in the rotational direction R2. In the embodiment, defining the outside diameter of the rear blades 151 as $R_r$, the minimum clearance $C_r$ between the rear blades 151 and the struts 161 is determined to fall within the range of $R_r/6>C_r>R_r/8$. Specifically, in the embodiment, the minimum clearance $C_r$ is $R_r/7.1$. This improves the air flow-static pressure characteristics, and reduces power consumption and noise.

The number N of the front blades 128, the number M of the struts 161, and the number P of the rear blades 151 are each a positive integer, and satisfy a relationship of N>P>M.

Figure 7A:
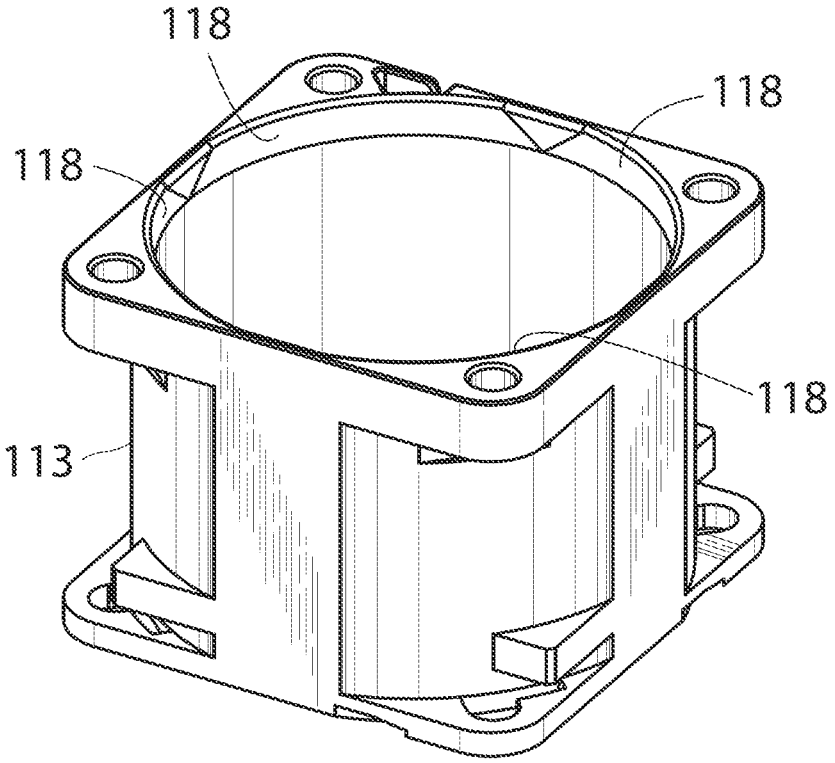
FIGS. 7A to 7C show an example of curved portions formed in an air channel.
Figure 7B:
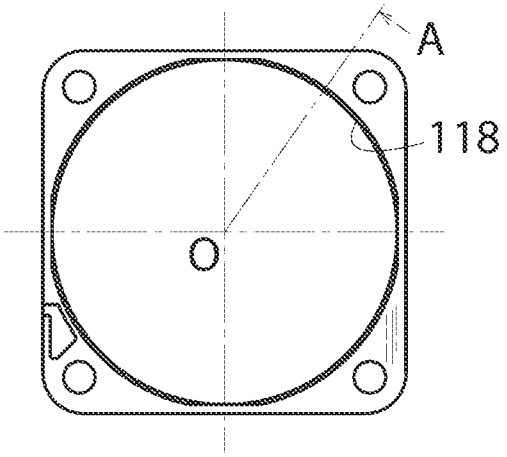
Figure 7C:
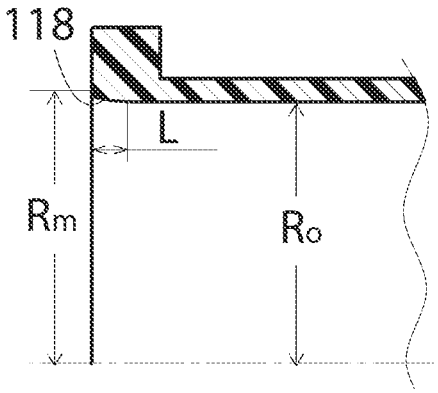

As shown in FIG. 3, four curved portions 118 and 158 are formed at four corners of both end portions, in the axial direction, of an inner wall portion of the air channel formed by the cylindrical portions 113 and 133, respectively. The curved portions 118 and 158 become larger in diameter toward a suction port 115 and a discharge port 157, respectively. FIGS. 7A to 7C show the curved portions 118. The four curved portions 118 and 158 are shaped such that defining the diameter of the inner wall portion of the air channel as $R_o$, the maximum diameter $R_m$ of the curved portions 118 at the end of the cylindrical portion 113 is $1.02R_o$ and the length L of the curved portions 118 from the opening portion of the air channel is $0.08R_o$ or more. That is, the curved portions 118 and 158 have a curved shape in which the inside diameter of the curved portions 118 to 158 becomes larger from $R_o$ to $1.02R_o$ over the length L. The maximum diameter $R_m$ according the embodiment is smaller than the maximum diameter $R_m$ of the curved portions in the structure according to the related art of FIGS. 1 and 2. Providing the curved portions 118 and 158 having varying diameters improves the air flow-static pressure characteristics, and enhances the effect to reduce noise.

Figure 8:
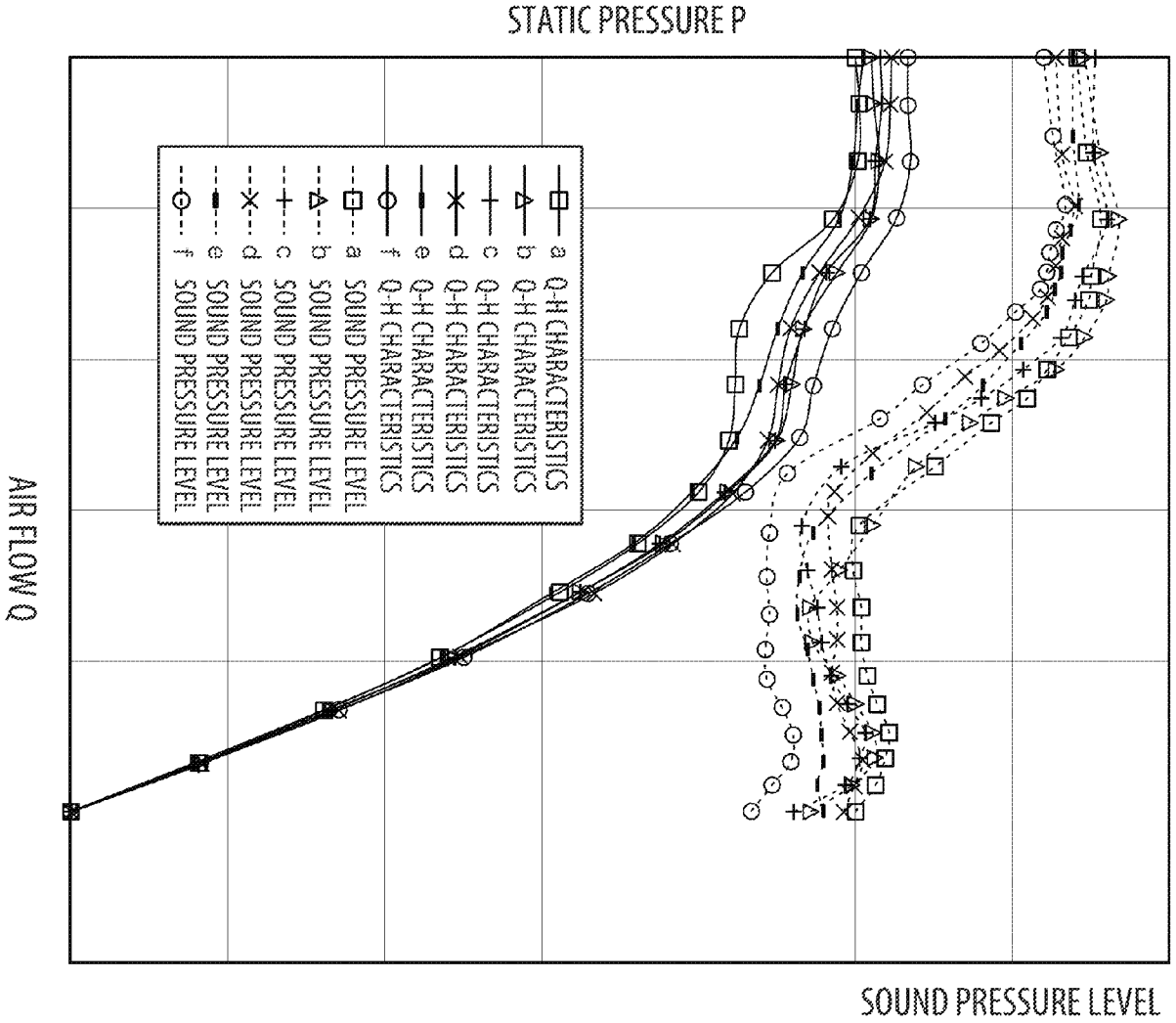
FIG. 8 shows an example of the results of an experiment conducted to verify the effect of the embodiment.

FIG. 8 relatively shows an example of the results of an experiment conducted to verify the effect of the embodiment. Thus, the horizontal and vertical axes of FIG. 8 represent relative magnitudes. In FIG. 8, experimental data a to e correspond to counter-rotating fans according to comparative examples, and experimental data f correspond to the counter-rotating fan according to the embodiment. The front blades and the rear blades of the counter-rotating fans used to obtain the experimental data a to f were configured as follows:

- Experimental data a: forward-swept front blades and forward-swept rear blades
- Experimental data b: swept-back front blades and swept-back rear blades (the related-art example of FIGS. 1 and 2)
- Experimental data c: swept-back front blades, and intermediate rear blades, which have a front end edge extending radially and thus are neither forward-swept blades nor swept-back blades
- Experimental data d: intermediate front blades and forward-swept rear blades
- Experimental data e: forward-swept front blades and swept-back rear blades
- Experimental data f: swept-back front blades and forward-swept rear blades Other conditions were as follows. Some of the following conditions are represented in terms of relative ratios with respect to a predetermined reference value, rather than specific numerical values, for generalization.

Number of blades (or struts)
- Front blades: 5
- Struts: 3
- Rear blades: 4

Rotational speed
- Front blades: (1.00±0.03)S (rpm)
- Rear blades: (0.94±0.02)S (rpm)
- where S is a reference value.

Minimum clearance between blades and struts
- $C_f$:$R_f$/4.6
- $C_r$:$R_r$/6.3
- where $C_f$ is the minimum clearance between the front blades and the struts,
- $C_r$ is the minimum clearance between the rear blades and the struts,
- $R_f$ is the diameter of the front blades, and
- $R_r$ is the diameter of the rear blades.

Maximum diameter of four curved portions
- $R_m$: 1.02$R_o$ (same for front and rear blades)
- where $R_o$ is the inside diameter of the air channel (reference value).

Inclination angle θ1, θ2 of front end edges of blades
- θ1 for front blades: +30° (forward-swept blades), 0° (intermediate blades), and −25° (swept-back blades)
- θ2 for rear blades: +30° (forward-swept blades), 0° (intermediate blades), and −30° (swept-back blades)

The sound pressure level of noise relative to variations in air flow was measured at a location 1 m away from the suction port.

As shown in FIG. 8, for half the range in which the air flow is up to the maximum air flow used as a normal operating point, the data f for the embodiment exhibited a lower sound pressure level and a higher static pressure compared to the data a to e for the comparative examples. Although not shown in FIG. 8, it was found that the order of power consumption was e>a>d>c>b>f. Therefore, it was found to be possible to improve the air flow-static pressure characteristics and to reduce power consumption and noise by using swept-back blades as the front blades and forward-swept blades as the rear blades.

Figure 9:
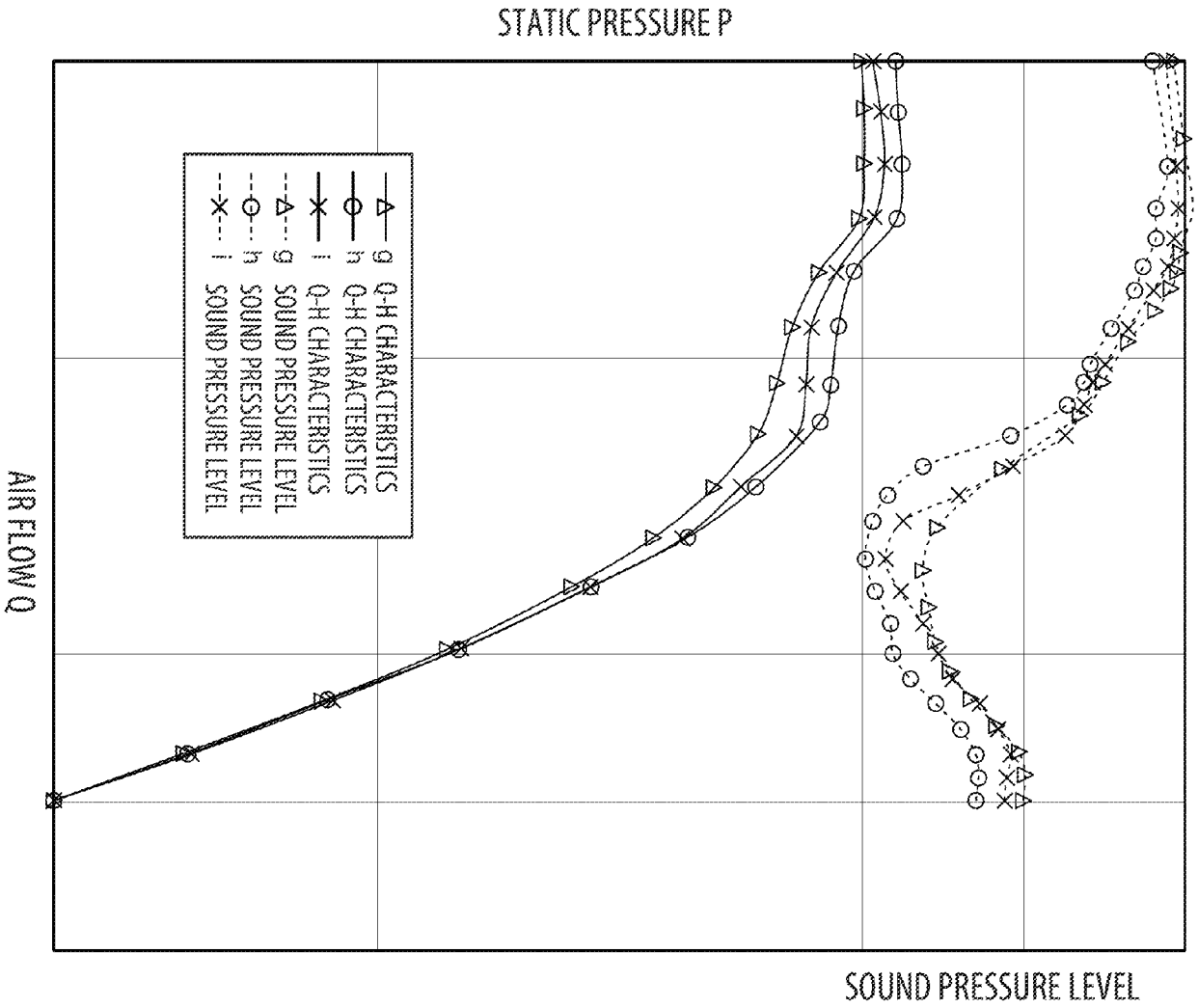
FIG. 9 shows the sound pressure level relative to variations in air flow and the air flow-static pressure characteristics (Q-H characteristics) when the maximum diameter of the curved portions at both ends of an inner wall portion of the air channel is varied.

FIG. 9 relatively shows the results of an experiment conducted to verify variations in static pressure and variations in sound pressure level caused by varying the shape of the four curved portions provided at the suction port and the discharge port. Thus, the horizontal and vertical axes of FIG. 9 represent relative magnitudes. In FIG. 9, experimental data g and i correspond to counter-rotating fans according to comparative examples, and experimental data h correspond to the counter-rotating fan according to the embodiment. The counter-rotating fans that derived the experimental data g to i were the same in configuration except that they were different in shape of the suction port and the discharge port as follows:

- Experimental data g: a related-art example in which the inside diameter $R_o$ of the air channel and the maximum diameter $R_m$ of the curved portions satisfy a relationship $R_m$=(1.05±0.01)$R_o$
- Experimental data h: the embodiment in which the inside diameter $R_o$ of the air channel and the maximum diameter $R_m$ of the curved portions satisfy a relationship $R_m$=(1.02±0.01)$R_o$
- Experimental data i: $R_m$=$R_o$ (a comparative example with no curved portions)

Also as shown in FIG. 9, for half the range in which the air flow is up to the maximum air flow used as a normal operating point, the data h for the embodiment exhibited a lower sound pressure level and a higher static pressure compared to the data g and i according to the related-art example and the comparative example. Although not shown in FIG. 9, it was found that the order of power consumption was i>g>h. Therefore, it was found to be possible to improve the air flow-static pressure characteristics and to reduce power consumption and noise by making the curved shape of the four curved portions provided at the suction port and the discharge port gentler than that according to the related art.

Figure 10:
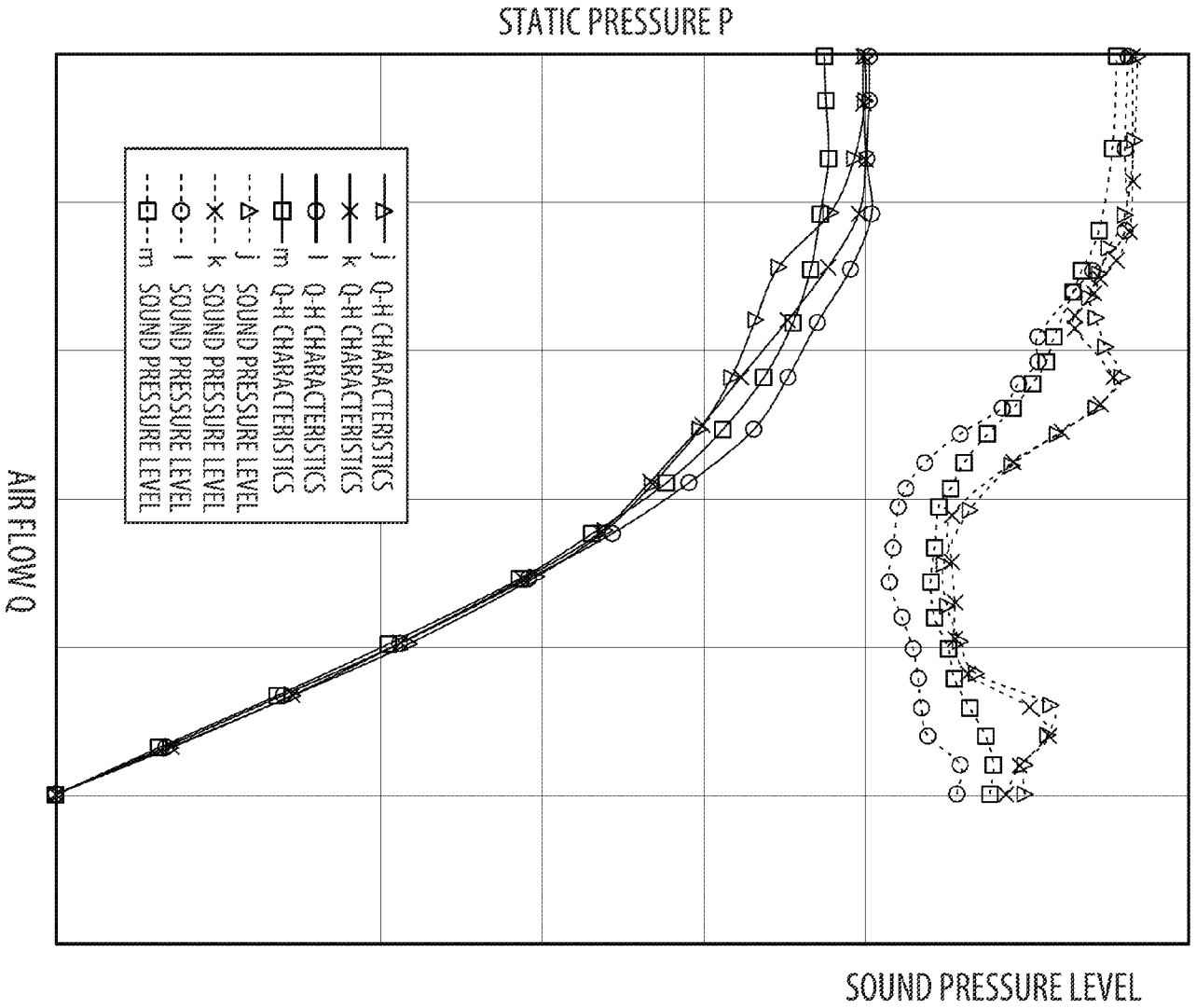
FIG. 10 shows the sound pressure level relative to variations in air flow and the air flow-static pressure characteristics (Q-H characteristics) when the minimum clearance $C_f$ between the front blades and struts is varied.

FIG. 10 relatively shows the results of an experiment conducted to verify variations in static pressure and variations in sound pressure level caused by varying the minimum clearance $C_f$ between the front blades and the struts. Thus, the horizontal and vertical axes of FIG. 10 represent relative magnitudes. In FIG. 10, experimental data j, k, and m correspond to counter-rotating fans according to comparative examples, and experimental data l correspond to the counter-rotating fan according to the embodiment. The counter-rotating fans that derived the experimental data j to m were the same in configuration except for the minimum clearance $C_f$. In the following, $R_f$ is the outside diameter of the front blades.

- Experimental data j: $C_f$=$R_f$/9
- Experimental data k: $C_f$=$R_f$/7
- Experimental data l: $C_f$=$R_f$/5 (which falls within the range of the embodiment)
- Experimental data m: $C_f$=$R_f$/3

Also as shown in FIG. 10, for half the range in which the air flow is up to the maximum air flow used as a normal operating point, the data l for the embodiment exhibited a lower sound pressure level and a higher static pressure compared to the data j, k, and m for the comparative examples. Although not shown in FIG. 10, it was found that the order of power consumption was j>k>m>l. In addition, although not shown in FIG. 10, it was found to be possible to improve the air flow-static pressure characteristics and to reduce power consumption and noise by using $C_f$ that satisfied $R_f$/4>$C_f$>$R_f$/6.

Figure 11:
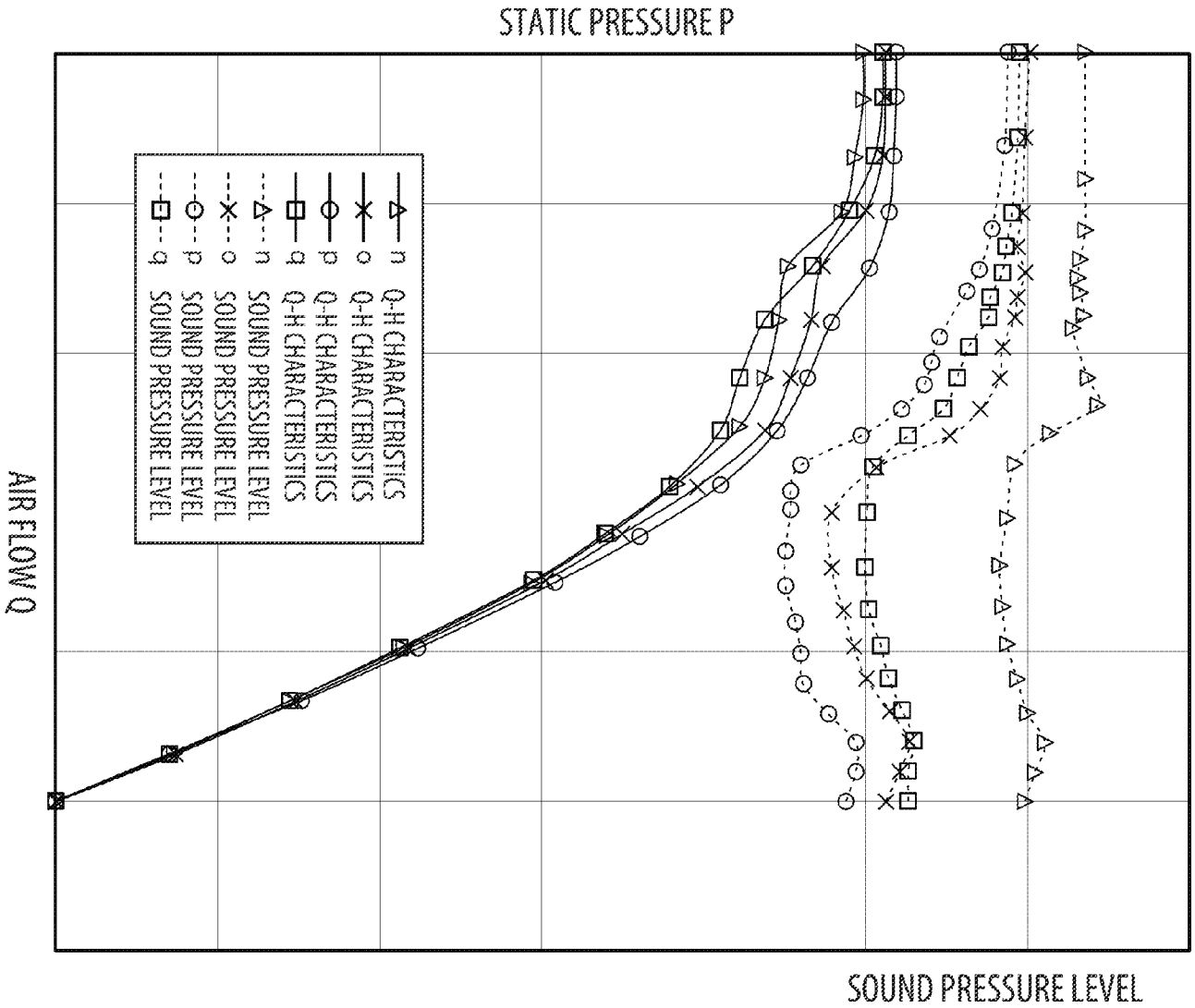
FIG. 11 shows the sound pressure level relative to variations in air flow and the air flow-static pressure characteristics (Q-H characteristics) when the minimum clearance $C_r$ between the rear blades and the struts is varied.

FIG. 11 relatively shows the results of an experiment conducted to verify variations in static pressure and variations in sound pressure level caused by varying the minimum clearance $C_r$ between the rear blades and the struts. Thus, the horizontal and vertical axes of FIG. 11 represent relative magnitudes. In FIG. 11, experimental data n, o, and q correspond to counter-rotating fans according to comparative examples, and experimental data p correspond to the counter-rotating fan according to the embodiment. The counter-rotating fans that derived the experimental data n to q were the same in configuration except for the minimum clearance $C_r$. In the following, $R_r$ is the outside diameter of the rear blades.

- Experimental data n: $C_r$=$R_r$/12
- Experimental data o: $C_r$=$R_r$/9
- Experimental data p: $C_f$=$R_f$/7 (which falls within the range of the embodiment)
- Experimental data q: $C_r$=$R_r$/5

Also as shown in FIG. 11, for half the range in which the air flow is up to the maximum air flow used as a normal operating point, the data p for the embodiment exhibited a lower sound pressure level and a higher static pressure compared to the data n, o, and q for the comparative examples. Although not shown in FIG. 11, it was found that the order of power consumption was n>q>o>p. In addition, although not shown in FIG. 11, it was found to be possible to improve the air flow-static pressure characteristics and to reduce power consumption and noise by using $C_r$ that satisfied $R_r$/6>$C_r$>$R_r$/8.

According to the counter-rotating axial flow fan of the present invention, it is possible to improve the air flow-static pressure characteristics and to reduce power consumption and noise compared to the existing counter-rotating axial flow fans, providing industrial applicability.

While certain features of the invention have been described with reference to example embodiments, the description is not intended to be construed in a limiting sense. Various modifications of the example embodiments, as well as other embodiments of the invention, which are apparent to persons skilled in the art to which the invention pertains, are deemed to lie within the spirit and scope of the invention.

What is claimed is:

1. A counter-rotating axial flow fan comprising:

a casing including an air channel having a suction port at one axial end of the air channel and a discharge port at the other axial end of the air channel;

a front impeller including a plurality of front blades and configured to rotate in the air channel;

a rear impeller including a plurality of rear blades and configured to rotate in the air channel in a direction opposite to a direction of rotation of the front impeller; and a plurality of struts disposed to be stationary between the front impeller and the rear impeller in the air channel, wherein:

the plurality of front blades are each formed of a swept-back blade, and the plurality of rear blades are each formed of a forward-swept blade, and defining the outside diameter of the front blades as $R_f$, the minimum clearance $C_f$ between the front blades and the struts is determined as a value in the range of $R_f/4>C_f>R_f/6$.

2. The counter-rotating axial flow fan according to claim 1, wherein defining the number of the front blades as N, the number of the struts as M, and the number of the rear blades as P, N, M, and P each being a positive integer, a relationship $N \geq P > M$ is satisfied, and a rotational speed of the front blades is higher than a rotational speed of the rear blades.

3. The counter-rotating axial flow fan according to claim 2, wherein:

a plurality of curved portions are formed at both end portions of an inner wall portion of the air channel in the axial direction, the curved portions becoming larger in diameter toward the suction port or the discharge port; and defining the diameter of the inner wall portion of the air channel as $R_o$, the maximum diameter $R_m$ of the curved portions is determined as $(1.02 \pm 0.01)R_o$.

4. The counter-rotating axial flow fan according to claim 1, wherein:

a plurality of curved portions are formed at both end portions of an inner wall portion of the air channel in the axial direction, the curved portions becoming larger in diameter toward the suction port or the discharge port; and defining the diameter of the inner wall portion of the air channel as $R_o$, the maximum diameter $R_m$ of the curved portions is determined as $(1.02 \pm 0.01)R_o$.

5. The counter-rotating axial flow fan according to claim 1, wherein defining the outside diameter of the rear blades as $R_r$, the minimum clearance $C_r$ between the rear blades and the struts is determined as a value in the range of $R_r/6>C_r>R_r/8$.

* * * * *